US005987931A

United States Patent [19]

Takahashi

[11] Patent Number: 5,987,931

[45] Date of Patent: Nov. 23, 1999

[54] KNIT DESIGN APPARATUS

[75] Inventor: Nobuyasu Takahashi, Wakayama, Japan

[73] Assignee: Shima Seiki Manufacturing Ltd., Wakayama, Japan

[21] Appl. No.: 08/932,821

[22] Filed: Sep. 18, 1997

Related U.S. Application Data

[62] Division of application No. 08/752,243, Nov. 21, 1996, Pat. No. 5,701,766.

[51] Int. Cl.[6] ..... D04B 7/10

[52] U.S. Cl. ..... 66/75.1; 66/77; 66/231; 66/238; 364/470.03

[58] Field of Search ..... 66/75.1, 75.2, 66/231, 232, 237, 60 R, 62, 70, 67, 238, 77; 364/470.01, 470.02, 470.03, 470.12

[56] References Cited

U.S. PATENT DOCUMENTS

| | | | |
|---|---|---|---|
| 4,167,861 | 9/1979 | Krause et al. | 66/232 X |
| 4,258,558 | 3/1981 | Tobe | 66/232 X |
| 4,608,642 | 8/1986 | Shima | 66/75.2 X |
| 4,774,819 | 10/1988 | Goller et al. | 66/75.2 |
| 5,388,050 | 2/1995 | Inoue et al. | 66/75.2 X |
| 5,557,527 | 9/1996 | Kotaki et al. | 66/75.2 X |
| 5,754,431 | 5/1998 | Kotaki . | |

FOREIGN PATENT DOCUMENTS

| | | |
|---|---|---|
| 0 449 549A2 | 10/1991 | European Pat. Off. . |
| 0 533 612A2 | 3/1993 | European Pat. Off. . |
| 0 638 678A1 | 2/1995 | European Pat. Off. . |
| 1 417 165 | 12/1975 | United Kingdom . |

*Primary Examiner*—John J. Calvert
*Assistant Examiner*—Larry D. Worrell, Jr.
*Attorney, Agent, or Firm*—Nikaido, Marmelstein, Murray & Oram LLP

[57] ABSTRACT

A tubular knitted fabric is broadened while fully preventing generation of open gap. Yarn is hooked on a needle of a second needle bed and twisted to form a loop, and this loop is transferred onto a first needle bed to become a broadening loop. A subsequent stitch is formed on the broadening loop and transferred back to the second needle bed. Yarn is hooked again on a needle of the second needle bed and twisted to form a loop, and this loop is transferred to the first needle bed to become a broadening loop.

4 Claims, 5 Drawing Sheets

KNIT DESIGN APPARATUS

This is a division of application Ser. No. 08/752,243 filed Nov. 21, 1996 now U.S. Pat. No. 5,701,766.

SPECIFICATION

A method for broadening a tubular knitted fabric by a flat knitting machine, a knit design apparatus and a memory therefor, and a knitted tubular fabric.

FIELD OF THE INVENTION

The present invention relates to broadening in making shaped knitting of a tubular knitted fabric with a flat knitting machine.

PRIOR ART

In knitting a fabric with a flat knitting machine, it is practiced to alter the knitting width by appropriately increasing or decreasing the number of stitches relevant to knitting a fabric of a desired shape. It is called shape knitting. Another method is also known wherein sleeves and a body are simultaneously knitted in respective tubular forms on a flat knitting machine, then the sleeves and the body are joined together to knit a garment such as a sweater in a substantially completed state. In the process, a sleeve portion to be knitted in a tubular form is made by first knitting a hem and gradually increasing the knitting width. The present applicant proposed a method of Japanese Patent Hei-3-51810 as a method for broadening such a tubular knitted fabric. According to this method, a broadening loop of a broadened portion is formed by twisting it one half turn or one turn before being knitted into the fabric. Hence the broadening loop length is reduced by this twisting, and as a result, generation of an open gap in the broadened part can be prevented. However, the above-mentioned is not necessarily effective in preventing generation of any open gap, depending on the kind of knitting yarn and/or knitting conditions.

SUMMARY OF THE INVENTION

One task of the present invention is to more effectively prevent generation of any open gap in a broadened part of a tubular knitted fabric.

According to the present invention, a flat knitting machine having at least a pair of abutting needle beds, each having a large number of needles, is used to hold a first knitted fabric on needles of a first needle bed, to hold a second knitted fabric on needles of a second needle bed, and to broaden a tubular knitted fabric comprising said first knitted fabric and said second knitted fabric.

The present invention comprising repeating a series of steps for forming a broadening loop, a series of steps for transferring the broadening stitch thus formed, and a series of steps for compensating for broadening.

According to the present invention, said series of steps for forming a broadening stitch includes a step of feeding yarn to needles holding the first knitted fabric to form a new row of stitches on the first knitted fabric, and feeding yarn to an empty needle of the second needle bed being outside the first knitted fabric to form a hooked part (step 5), a subsequent step of twisting said hooked part on the second needle bed to make prolongations on both sides of the hooked part cross and change it into a loop, and feeding yarn to needles holding the second knitted fabric to form a new row of stitches on the second knitted fabric (step 6), and a subsequent step of transferring said loop onto an empty needle being outside the first knitted fabric on the first needle bed to make it a broadening loop (step 7).

According to the present invention, said series of steps for transferring said formed broadening stitch includes a step of feeding yarn to needles holding the first knitted fabric except a needle corresponding to said broadening loop to form a new row of stitches on the first knitted fabric (step 10), subsequent steps of feeding yarn to the needle corresponding to said broadening loop on the first needle bed to form a stitch subsequent to the broadening loop, and feeding yarn to needles holding the second knitted fabric to form a new row of stitches on the second knitted fabric (step 11~step 13), and a subsequent step of transferring the stitch subsequent to said broadening loop on the first needle bed to an empty needle outside the second knitted fabric on the second needle bed to broaden the second knitted fabric (step 14).

Furthermore, according to the present invention, said series of steps for compensating for broadening includes a step of feeding yarn to needles holding the first knitted fabric to form a new row of stitches on the first knitted fabric, and feeding yarn to an empty needle outside the first knitted fabric to form a hooked part (step 15), a subsequent step of twisting said hooked part on the second needle bed to change it into a loop, and feeding yarn to needles holding the second knitted fabric to form a new row of stitches on the second knitted fabric (step 16), and a subsequent step of transferring said loop on the second needle bed onto an empty needle outside the first knitted fabric on the first needle bed to broaden the first knitted fabric (step 17).

Preferably, provided between said series of steps for forming a broadening stitch and said series of steps for transferring a formed broadening stitch is a step of feeding yarn to needles holding the first knitted fabric and the needle corresponding to said broadening loop to form a new row of stitches on the first knitted fabric (step 8), and a step of feeding yarn to needles holding the second knitted fabric to form a new row of stitches on the second knitted fabric (step 9).

Preferably, said flat knitting machine has four abutting needle beds, a first lower needle bed and a first upper needle bed and a second lower needle bed and a second upper needle bed, and said first knitted fabric is held on needles of the first lower needle bed, said second knitted fabric is held on needles of the second lower needle bed, and said respective hooked parts are formed on needles of the first upper needle bed or the second upper needle bed.

The concept of holding knitted fabrics is explained as follows: When both the first knitted fabric and the second knitted fabric are comprised of face stitches only, the first knitted fabric will be held on the first needle bed and knitted by needles on this needle bed. Similarly, the second knitted fabric will be held and knitted on the second needle bed. When both face stitches and back stitches are present, face stitches of the first knitted fabric will be formed by needles of the first needle bed, and back stitches will be formed by needles of the second needle bed. Moreover, face stitches of the second knitted fabric will be formed by needles of the second needle bed, and back stitches will be formed by needles of the first needle bed. When both face stitches and back stitches are present in a mixed manner, one knitted fabric will be knitted on two needle beds. In case of a tubular knitted fabric, the entirety of one knitted fabric may be on one needle bed. In this case, knitted fabrics will be held on needle beds for forming their face stitches: Which knitted fabric is to be held on which needle bed is determined according to this condition.

The present invention rests on a knit design apparatus that develops a knitting program for driving a flat knitting machine having at least a pair of abutting needle beds, each having a large number of needles, holding a first knitted fabric on needles of a first needle bed and a second knitted fabric on needles of a second needle bed, and broadening a tubular knitted fabric being comprised of said first knitted fabric and said second knitted fabric by means of said flat knitting machine.

This knit design apparatus is provided with a means for generating instructions for feeding yarn to needles holding the first knitted fabric to form a new row of stitches and feeding yarn to an empty needle outside of the first knitted fabric on the second needle bed to form a hooked part, a means for generating instructions for twisting said hooked part on the second needle bed to change it into a loop and feeding yarn to needles holding the second knitted fabric to form a new row of stitches on the second knitted fabric, a means for generating instructions for transferring said loop onto an empty needle outside of the first knitted fabric on the first needle bed to make it a broadening loop, a means for generating instructions for feeding yarn to needles holding the first knitted fabric except the needle corresponding to said broadening loop to form a new row of stitches on the first knitted fabric, a means for generating instructions for feeding yarn to the needle corresponding to said broadening loop on the first needle bed to form a stitch subsequent to the broadening loop and feeding yarn to needles holding the second knitted fabric to form a new row of stitches on the second knitted fabric, a means for generating instructions for transferring the stitch subsequent to said broadening loop on the first needle bed to an empty needle outside the second knitted fabric on the second needle bed to broaden the second knitted fabric, a means for generating instructions for feeding yarn to needles holding the first knitted fabric to form a new row of stitches on the first knitted fabric and feeding yarn to an empty needle outside the first knitted fabric on the second needle bed to form a hooked part, a means for generating instructions for twisting said hooked part on the second needle bed to change it into a loop and feeding yarn to needles holding the second knitted fabric to form a new row of stitches on the second knitted fabric, and a means for generating instructions for transferring said loop on the second needle bed onto an empty needle outside the first knitted fabric on the first needle bed to broaden the first knitted fabric.

The present invention also rests on a memory that can be read by a computer of a flat knitting machine having at least a pair of abutting needle beds, each having a large number of needles, and that is made to store a knitting program for holding a first knitted fabric on needles of a first needle bed, holding a second knitted fabric on needles of a second needle bed, and broadening a tubular knitted fabric being comprised of said first knitted fabric and second knitted fabric by means of said flat knitting machine.

The memory is provided with instructions for feeding yarn to needles holding the first knitted fabric to form a new row of stitches on the first knitted fabric and feeding yarn to an empty needle outside the first knitted fabric on the second needle bed to form a hooked part, subsequent instructions for twisting said hooked part on the second needle bed to change it into a loop and feeding yarn to needles holding the second knitted fabric to from a new row of stitches on the second knitted fabric.

subsequent instructions for transferring said loop onto an empty needle outside the first knitted fabric on the first needle bed to make it a broadening loop, subsequent instructions for feeding yarn to needles holding the first knitted fabric except the needle corresponding to said broadening loop to form a new row of stitches on the first knitted fabric, subsequent instructions for feeding yarn to the needle corresponding to said broadening loop on the first needle bed to form a stitch subsequent to the broadening loop and feeding yarn to needles holding the second knitted fabric to form a new row of stitches on the second knitted fabric.

subsequent instructions for transferring the stitch subsequent to said broadening loop on the first needle bed onto an empty needle outside the second knitted fabric on the second needle bed to broaden the second knitted fabric, subsequent instructions for feeding yarn to needles holding the first knitted fabric to form a new row of stitches on the first knitted fabric and feeding yarn to an empty needle outside the first knitted fabric on the second needle bed to form a hooked part, subsequent instructions for twisting said hooked part on the second needle bed to change it into a loop and feeding yarn to needles holding the second knitted yarn to form a new row of stitches on the second knitted fabric, and subsequent instructions for transferring said loop on the second needle bed to an empty needle outside the first knitted fabric on the first needle bed to broaden the first knitted fabric.

Furthermore, the present invention rests on a tubular knitted fabric broadened by the above-mentioned method.

The present invention will be explained in the following. Said formation of a broadening stitch itself (steps 5 through 7) is identical to that described in Japanese Patent Hei-3-51810. Assume that a first knitted fabric is held on a first needle bed and a second knitted fabric is held on a second needle bed. In both inventions, a hooked part is formed on an empty needle of the second needle bed, then, for example, the movement of a yarn feeder is reversed to twist the hooked part to change it into a loop, then the loop is transferred onto the first needle bed to make it a broadening loop. According to Japanese Patent Hei-3-51810, this broadening loop will become a broadening stitch of the first knitted fabric. In contrast to it, according to the present invention, a stitch having a twist or stitch having crossing yarns at the root thereof is formed later in the wale of this broadening loop, and this stitch is transferred back to the second needle bed. This is broadening transfer. At this point, such broadening has been given to the second knitted fabric, and no broadening has been given to the first knitted fabric yet. To compensate this, a hooked part will be formed on the second needle bed and the part will be twisted to make a loop. Then the loop will be transferred onto the first needle bed to become a broadening loop of the first knitted fabric.

According to the present invention, a stitch having yarns crossed at the root thereof is formed in the wale of the broadening loop provided in the formation of a broadening stitch, then this stitch is transferred back to the second needle bed to prevent generation of open gap in the broadened part as much as possible.

According to the present invention, generation of open gap in a broadening formation part of a tubular knitted fabric can be prevented as much as possible. When release knitting is inserted during broadening knitting, a broadening line can be levelled to knit a beautifully finished tubular knitted fabric.

In the following, an embodiment will be shown wherein all stitches around a broadened part are face stitches. However, when back stitches are included, it is sufficient to use the needle bed opposite to the needle bed used in the embodiment to form a stitch.

EMBODIMENT

Figure 1:
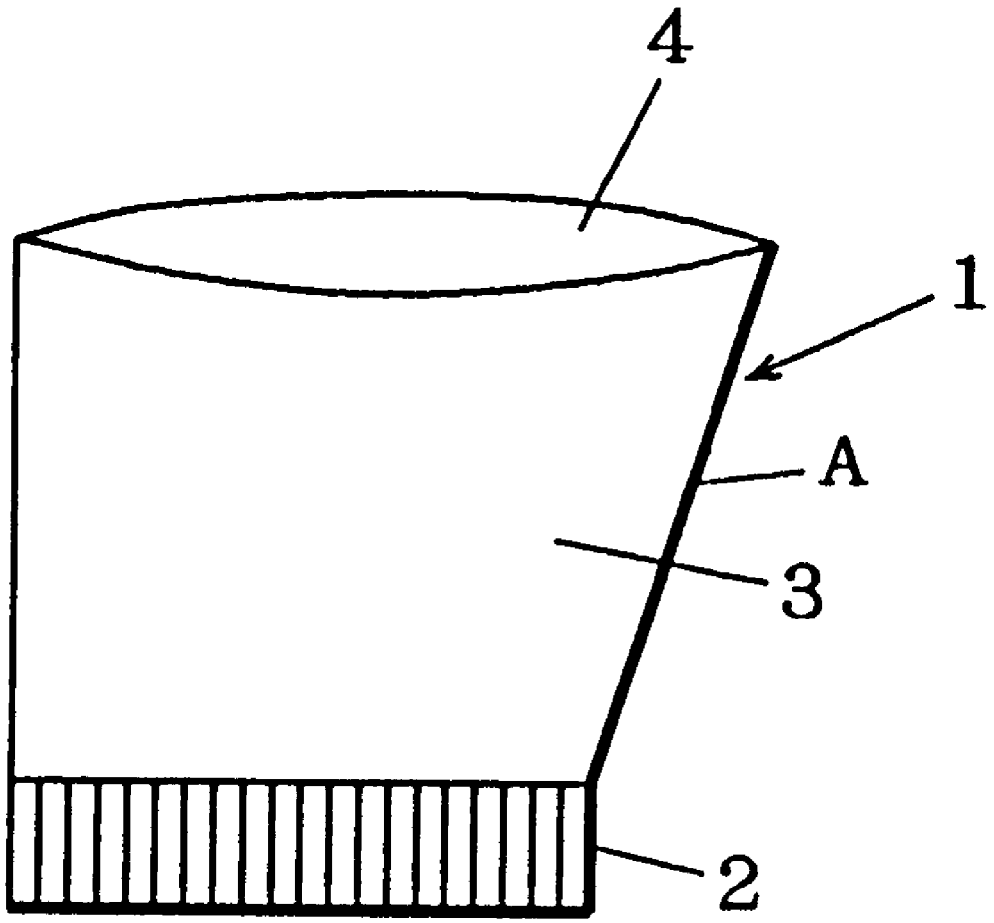
FIG. 1 shows an example of applying the broadening method of the present invention to a sleeve of a sweater.

An embodiment of the present invention, a sleeve member 1 to be knitted tubularly in plain stitch, will be explained, by way of example, with reference to the drawings. FIG. 1 is a front view of a sleeve member 1 knitted tubularly, and A denotes a broadening line. The broadening knitting method according to the present invention can be worked either with a flat knitting machine with two beds wherein a pair of a front needle bed and a rear needle bed are arranged to oppose each other or with a flat knitting machine with four beds wherein one more pair of a front needle bed and a rear needle bed are arranged to oppose each other, thus two upper needle beds and two lower needle beds are used.

Technology for shape knitting of a tubular knitted fabric such as a sweater by means of a flat knitting machine with two beds is disclosed in Japanese Patent Hei-3-75656. In this technology, needles, for example, of odd numbers on a needle bed are used for a front knitted fabric, and needles of even numbers on the other needle bed are used for a back knitted fabric: Every other needle is used on the front needle bed and on the rear needle bed, respectively. With this arrangement, each stitch of a knitted fabric on one needle bed always has a needle for transfer on the other opposing needle bed. As a result, structural patterns having a mixture of face stitches and back stitches, such as links, garter and rib, can be knitted, and a sleeve member can be shifted crosswise to be joined with a body.

When a flat knitting bed with four beds is used, a front knitted fabric is knitted by using a lower front bed and an upper rear bed, and similarly, a back knitted fabric is knitted by using a lower rear bed and an upper front bed. In this case, unlike the case of a flat knitting machine with two beds, there is no need of assigning needles for transfer.

In the following, knitting with a flat knitting machine with two beds will be described in detail. A cam carriage of a flat knitting machine to be used in the present embodiment is provided with at least two can systems having both knitting and transfer functions. Thus two processes of knitting and transfer can be executed simultaneously by a single traverse of the cam carriage.

Figure 2:
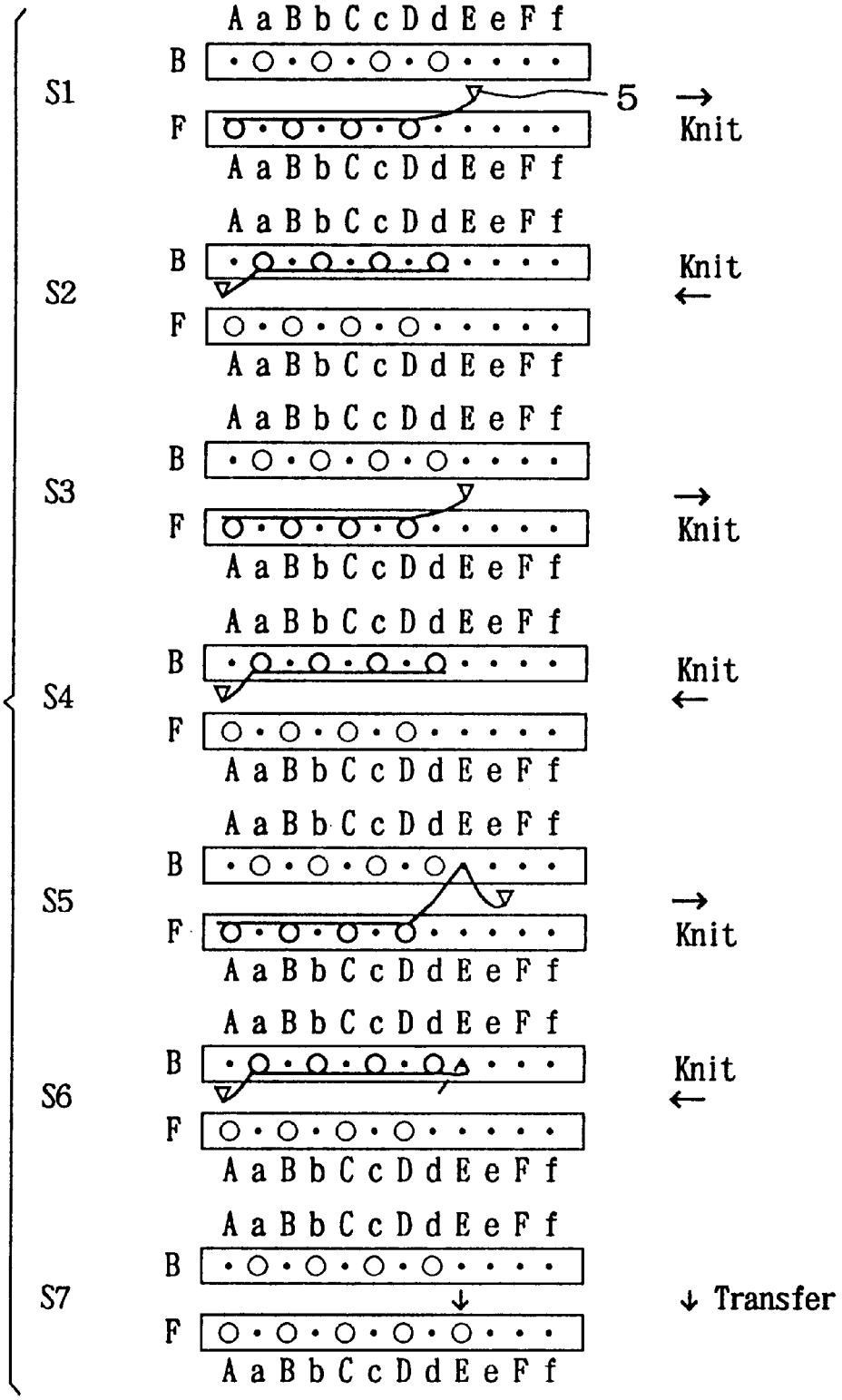
FIG. 2 shows a part of knitting steps for knitting the above-mentioned fabric by means of a flat knitting machine with two needle beds, illustrating stitches of knitted fabrics held on a front bed and a rear bed, the state of supply of yarn, and transfer of a stitch.
Figure 3:
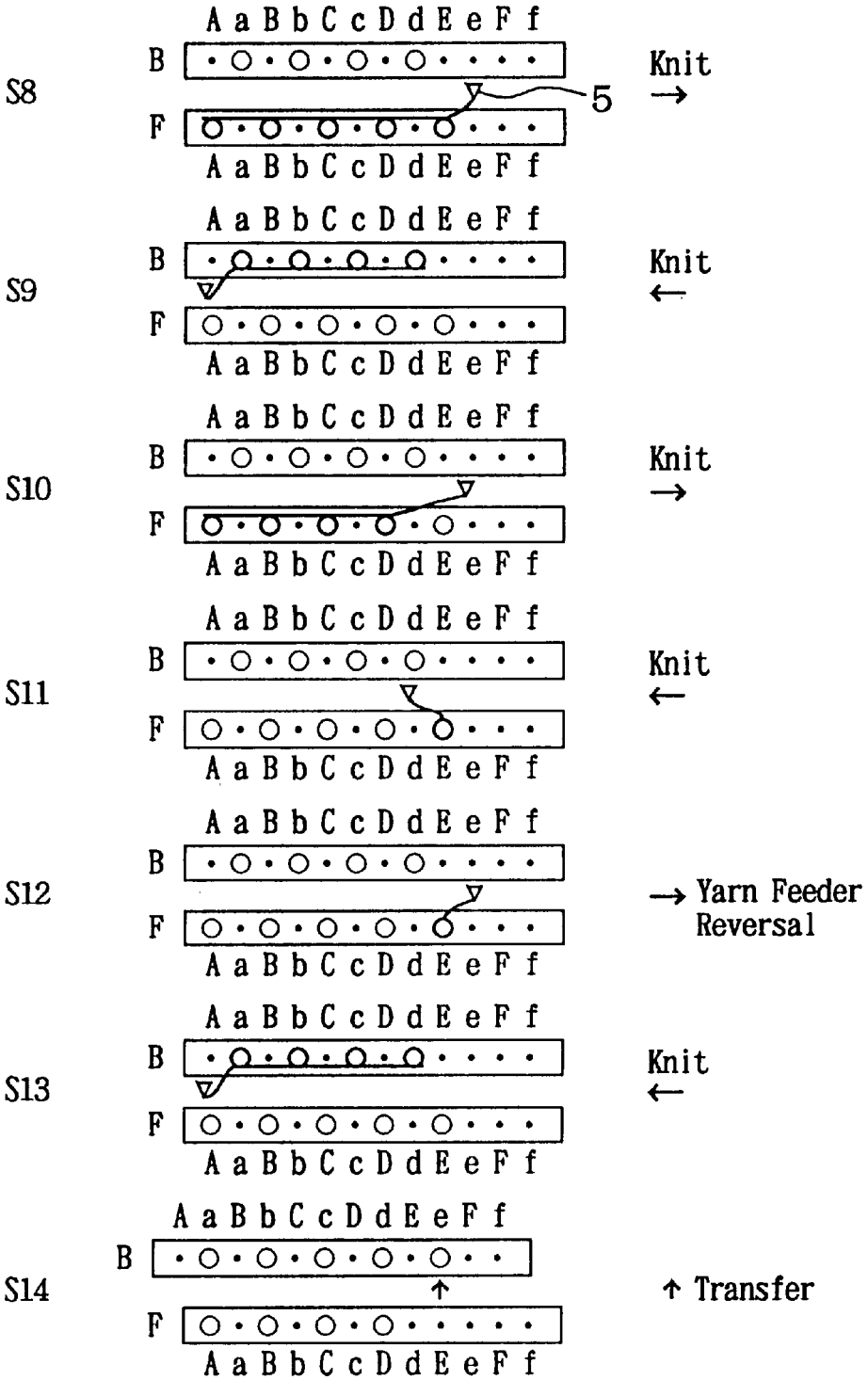
FIG. 3. like FIG. 2, shows knitting steps that are subsequent to the knitting steps of FIG. 2.
Figure 4:
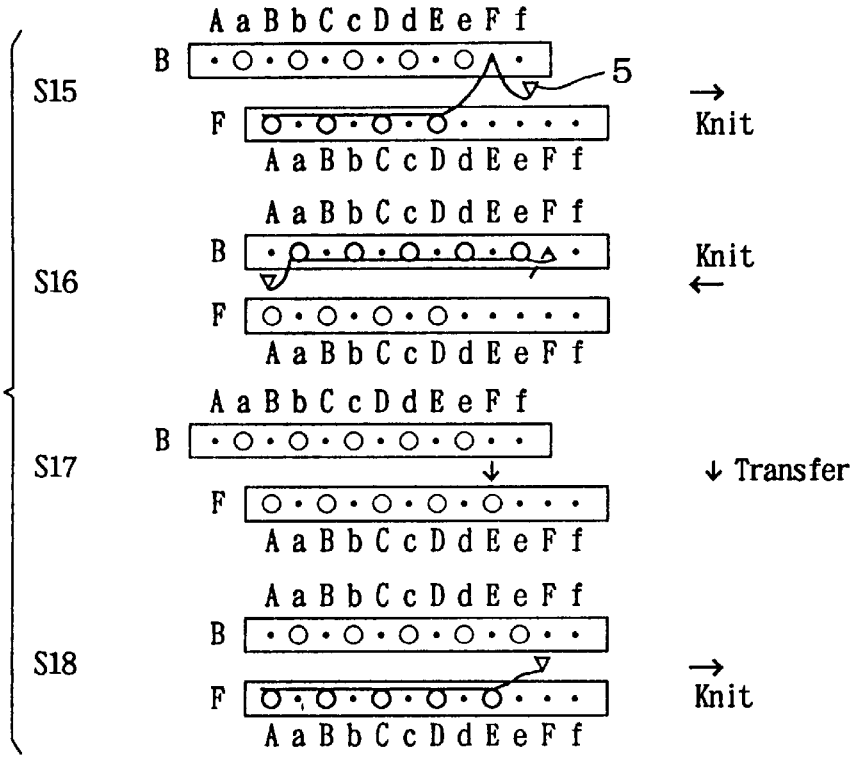
FIG. 4. like FIG. 2, shows knitting steps that are subsequent to the knitting steps of FIG. 3.

FIG. 2 through FIG. 4 show the knitting steps of the knitting method of the embodiment (step numbers are expressed by, for example, step 1). A front knitted fabric 3 of a sleeve member 1 to be knitted tubularly is knitted by odd number needles marked, from the left of each needle bed, with capital letters of the alphabet. A back knitted fabric 4 of the sleeve member 1 is knitted by even number needles marked by small letters of the alphabet. The numbers of needles indicated in the knitting steps are smaller than the actual numbers of needles for the convenience of explanation.

Tubular knitting after completion of a waist band

After the completion of knitting of a waist band 2 of the sleeve member 1 (not illustrated), knitting of step 1 through step 4 is done to feed yarn to needles A through D on the front needle bed and needles d through a on the rear needle bed circumferentially to knit tubularly the sleeve portion subsequent to the waist band 2. Mark 5 in the diagram denotes a yarn feeder 5. The above-mentioned knitting may be omitted, if necessary.

Formation of broadening loop

In step 5 through step 7, a broadening loop is formed at the right end of the front knitted fabric 3. In step 5, the yarn feeder 5 is used to feed yarn to needles A through D of the front needle bed to knit the front knitted fabric 3 and feed yarn to the needle E on the rear needle bed and hook yarn on the needle E. In step 6, the yarn feeder 5 is reversed to twist the hooked part to change it into a loop, and yarn is fed to needles d through a on the rear needle bed to knit the back knitted fabric 4. In step 7, the loop, which was hooked on the needle E on the rear needle bed in the above-mentioned step 5, is transferred onto the needle E on the front needle bed. With this, the number of wales of the front knitted fabric is increased by one.

Release knitting

In step 8 and step 9, yarn is fed to needles A through E on the front needle bed and to needles d through a of the rear needle bed to knit the front knitted fabric 3 and the back knitted fabric 4 by one course each. This release knitting will level the knitted fabric surface of the broadening line A. This knitting, however, is not indispensable. It can be omitted when the knitting width of a tubular knitted fabric must be increased more quickly.

Transfer of a broadening stitch

Subsequent step 10 through step 14 show a process of transferring a stitch located at the right end of the front knitted fabric 3 to the back knitted fabric 4. Yarn is fed to needles A through D, except E, of needles A through E holding stitches of the front knitted fabric 3 to knit one course of the front knitted fabric 3. In the process, the yarn feeder 5 is shifted, after feeding yarn to the needle D, to a point beyond the needle E (step 10). Then the yarn feeder 5 is shifted to the left to feed yarn to the needle E, to which yarn was not fed in the preceding step, to form a stitch (step 11). After that, the yarn feeder 5 is shifted to the right (step 12). No stitch formation is made in that step. Next, in step 13, yarn is fed to needles d through a on the rear needle bed to knit the rear knitted fabric 4. In subsequent step 14, the rear needle bed is racked to the left by one needle, and a stitch, which was formed in the above-mentioned step 12 and has been held on the needle E of the front needle bed, is transferred to the needle e on the rear needle bed. With this, the number of wales of the back knitted fabric 4 has been increased by one. In step 11, said transferred stitch was made to have yarns crossed at the root thereof in advance by reversing the yarn feed direction. As a result, when the stitch is transferred to the rear needle bed, the crossing of yarns will be eliminated. Hence the transferred stitch will have the same stitch structure with the stitches formed by needles of the rear needle bed and will not impair the appearance of the knitted fabric. In the embodiment, three steps, step 11 through step 13, were used. These steps may be integrated into one step. In other words, after transferring the stitch onto the needle E of the front needle bed in step 11, reshifting of the yarn feeder (step 12) will not be made, and knitting of step 13 will be made immediately.

Broadening compensation for transferred stitch

In step 15 through step 17, the loss of a stitch, due to the transfer of the above-mentioned stitch of the front knitted fabric 3 to the back knitted fabric 4, is compensated. To this end, a broadening stitch is made again at the right end of the front knitted fabric. In step 15, the yarn feeder 15 is used to feed yarn to needles A through D on the front needle bed to knit the front knitted fabric and yarn is also fed to the needle F on the rear needle bed and hooked on it. At the time, the rear needle bed is racked as shown in the diagram. If a wide rib structure wherein face stitches are back stitches are present in a mixed manner is to be knitted as a front knitted fabric 3, the positional relationship of the front needle bed and the rear needle bed may be restored to the state shown in step 13. In subsequent step 16, the hooked part is twisted to make a loop, and yarn is fed to needles e through a on the rear needle bed to knit one course of the back knitted fabric 4. In step 17, the loop that was hooked on the needle F on the rear needle bed in step 15 is transferred onto the needle E on the front needle bed to form a broadening loop of the front knitted fabric, and in turn, to increase the number of wales by one.

With the knitting so far, the knitting widths of the front and back knitted fabrics comprising a tubular knitted fabric have been increased by one, respectively.

Repeat knitting

The knitting width of the tubular knitted fabric can be increased by a desired number of wales by repeating knitting similar to that shown in step 5 through step 17 and in knitting step 18 and after.

Modification

Figure 5:
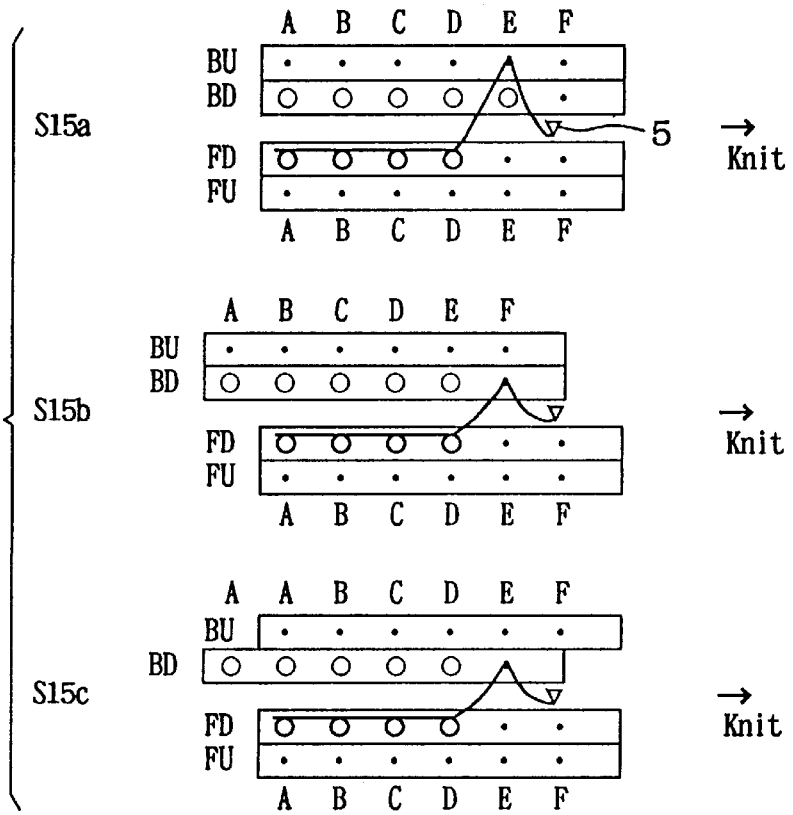
FIG. 5 shows a part of a procedure for knitting the above-mentioned knitted fabric by means of a flat knitting machine with four needle beds, in particular, versions of a knitting step corresponding to the step 15 of FIG. 4.

FIG. 5 shows knitting with a flat knitting machine with four beds that corresponding to step 15 of FIG. 4. Marks FD, FU, BD and BU in the diagram denote a lower front bed, upper front bed, lower rear bed and upper rear bed, respectively. No auxiliary needles for transfer (needles indicated by small characters of the alphabet) are present among needles A through E. As is known widely, with regard to the basic knitting of a tubular knitted fabric by means of a flat knitting bed with four beds, a front knitted fabric 3 is knitted by using needles of a lower front needle bed and an upper rear needle bed, and similarly a rear knitted fabric 4 is knitted by using needles of a lower rear needle bed and an upper front needle bed.

In FIG. 5, step 15*a*, broadening of the front knitted fabric 3 is made by using a needle E on the upper rear bed, that is in the same phase with the needle E on the lower rear bed onto which a broadening stitch of the back knitted fabric 4 is held, to hook yarn. However, in case of a flat knitting machine with four beds, in comparison with a flat knitting machine with two beds, there are plural empty needles that can be used. Thus the yarn feeding method is not limited to one mentioned above. Various methods are possible. For example, in place of the knitting process mentioned above, those shown in FIG. 5, steps 15*b* and 15*c* are possible. In FIG. 5. step 15*b*, the upper rear needle bed and the lower rear needle bed are racked together as an integral unit by a common mover. Like the knitting on a flat knitting machine with two beds, a needle adjacent to the back knitted fabric (the needle F on the lower rear needle bed) is used for broadening. FIG. 5, step 15*c* shows a case where the upper bed and the lower bed of the rear needle beds can be racked independently of each other. Yarn is fed to needles A through D on the lower front needle bed and yarn is hooked on the needle F on the lower rear needle bed to form a broadening loop of the front knitted fabric 3. Knitting of this step is made by racking only the lower rear needle bed to the left by one needle.

Figure 6:
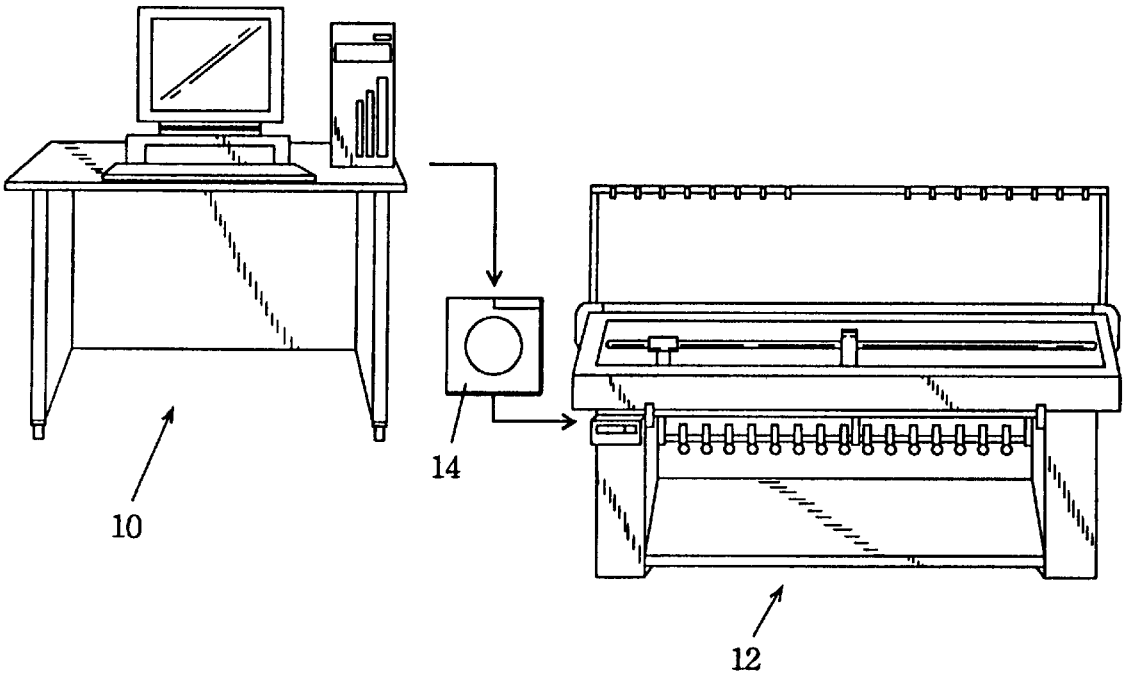
FIG. 6 is a diagram showing the relationship between a knit design apparatus and a flat knitting machine.

FIG. 6 shows a memory 14 of the present invention. In the diagram, 10 is a knit design apparatus, being a CAD system for designing a fabric to be knitted. For hardware of the design apparatus 10, Total Design System (Total Design System is a trade name) of the present applicant, for example, may be used, 12 is a flat knitting machine for knitting a knitted fabric according to the design. The flat knitting machine 12 is provided with, for example, a pair of or two pairs of needle beds, and also with a cam carriage or cam carriages for operating needles on the needle beds. A yarn feeder is trained by, for example, a cam carriage. In addition to them, a motor or the like is provided to rack a needle bed relative to another needle bed.

A designer uses the design apparatus 10 to design a tubular knitted fabric, and inputs the design apparatus 10 instructions for broadening sleeves or the body. For instance, when broadening is made as indicated in the drawings of the embodiment, broadening by one stitch is made for the front knitted fabric and the back knitted fabric for every four courses of the front knitted fabric and the back knitted fabric, respectively. If the release knitting is omitted, broadening by one stitch is made for every three courses of the front knitted fabric and the back knitted fabric, respectively. The design apparatus determines, from a design drawing inputted by the designer, for every what courses broadening is made. If the designer inputs a broadening condition that generates an open gap or that can not be knitted, the design apparatus will, for example, modify the design drawing.

The design apparatus acts as means for storing knitting operations such as broadening, as subroutines, checks for every course broadening is made, and applies the broadening method of the present invention. In short, the design apparatus decides that broadening of a particular part is made by the knitting procedure according to the present invention. The design apparatus changes the design drawing thus inputted into a knitting procedure and outputs it in the form of a knitting program to the memory 14. The memory 14 may be a floppy disc, an optomagnetic disc, etc., and the stored knitting program is read by a disc drive of the flat knitting machine 12. A computer stored in the flat knitting machine 12 breaks the knitting program into control elements such as operations of a cam carriage, racking of needle beds and control of a yarn feeder, to control the mechanisms of the flat knitting machine 12.

In the above-mentioned embodiment, tubular knitting of a plain knit fabric was taken as an example to explain the broadening knitting according to the present invention. Hence the above-mentioned embodiment does not require a process of selectively transferring a stitch when knitting shifts from a front knitted fabric to a back knitted fabric or from a back knitted fabric to a front knitted fabric. However, when a tubular knitted fabric having both face stitches and back stitches such as a wide rib is to be knitted, it is naturally required to add a process of selective transferring. The knitting method of the present invention is not limited to the above-mentioned embodiment and may be modified as far as it does not deviate from the present invention.

I claim:

1. A knit design apparatus that develops a knitting program for driving a flat knitting machine having at least a pair of abutting needle beds, each having a large number of needles, holding a first knitted fabric on needles of a first needle bed and a second knitted fabric on needles of a second needle bed, and broadening a tubular knitted fabric being comprised of said first knitted fabric and said second knitted fabric by means of said flat knitting machine, said knit design apparatus being provided with a means for generating instructions for feeding yarn to needles holding the first knitted fabric to form a new row of stitches and feeding yarn to an empty needle outside the first knitted fabric on the second needle bed to form a hooked part, a means for generating instructions for twisting said hooked part on the second needle bed to change it into a loop and feeding yarn to needles holding the second knitted fabric to form a new row of stitches on the second knitted fabric, a means for generating instructions for transferring said loop onto an empty needle outside of the first knitted fabric on the first needle bed to make it a broadening loop, a means for generating instructions for feeding yarn to needles holding the first knitted fabric except the needle corresponding to said broadening loop to form a new row of stitches on the first knitted fabric, a means for generating instructions for feeding yarn to the needle corresponding to said broadening loop on the first needle bed to form a stitch subsequent to the broadening loop and feeding yarn to needles holding the second knitted fabric to form a new row of stitches on the second knitted fabric, a means for generating instructions for transferring the stitch subsequent to said broadening loop on the first needle bed to an empty needle outside the second knitted fabric on the second needle bed to broaden the second knitted fabric, a means for generating instructions for feeding yarn to needles holding the first knitted fabric to form a new row of stitches on the first knitted fabric and feeding yarn to an empty needle outside the first knitted fabric on the second needle bed to form a hooked part, a means for generating instructions for twisting said hooked part on the second needle bed to change it into a loop and feeding yarn to needles holding the second knitted fabric to form a new row of stitches on the second knitted fabric, and a means for generating instructions for transferring said loop on the second needle bed onto an empty needle outside the first knitted fabric on the first needle bed to broaden the first knitted fabric.

2. A knit design apparatus as recited in claim 1, said knit design apparatus further comprising:

means for generating instructions for feeding yarn to needles holding the first knitted fabric and the needle corresponding to said broadening loop to form a new row of stitches on the first knitted fabric, and for feeding yarn to needles holding the second knitted fabric to form a new row of stitches on the second knitted fabric are provided.

3. A knit design apparatus according to claim 1, wherein said flat knitting machine comprises four abutting needle beds, a first lower needle bed, a first upper needle bed, a second lower needle bed, and a second upper needle bed, and wherein said first knitted fabric is held on needles of the first lower needle bed, the second knitted fabric is held on needles of the second lower needle bed, and said respective hooked parts are formed on needles of the first upper needle bed or the second upper needle bed.

4. A knit design apparatus according to claim 1, further comprising:

means for generating instructions for forming face stitches by needles of the first needle bed and forming back stitches by needles on the second needle bed for a new row of stitches on the first knitted fabric, and means for generating instructions for forming face stitches by needles on the second needle bed and forming back stitches by needles on the first needle bed for a new row of stitches on the second knitted fabric.

* * * * *

UNITED STATES PATENT AND TRADEMARK OFFICE

CERTIFICATE OF CORRECTION

PATENT NO. : 5,987,931

DATED : November 23, 1999

INVENTOR(S) : Takahashi

It is certified that error appears in the above-identified patent and that said Letters Patent is hereby corrected as shown below:

On the title page,

Item [54], pleas delete "KNIT DESIGN APPARATUS", and insert therefor, -- A METHOD FOR BROADENING A TUBULAR KNITTED FABRIC BY A FLAT KNITTING MACHINE, A KNIT DESIGN APPARATUS AND A MEMORY THEREFOR, AND A KNITTED TUBULAR FABRIC --

Signed and Sealed this

Thirteenth Day of March, 2001

*Attest:*

Nicholas P. Godici

NICHOLAS P. GODICI

*Attesting Officer*

*Acting Director of the United States Patent and Trademark Office*